United States Patent [19]

Burghardt et al.

[11] 4,200,471

[45] Apr. 29, 1980

[54] PROCESS FOR CLEANING SPINNERETS

[75] Inventors: Wolfgang Burghardt, Bobingen; Wilhelm Bronner, Königsbrunn, both of Fed. Rep. of Germany

[73] Assignee: Hoechst Aktiengesellschaft, Frankfurt am Main, Fed. Rep. of Germany

[21] Appl. No.: 862,524

[22] Filed: Dec. 20, 1977

[30] Foreign Application Priority Data

Dec. 22, 1976 [DE] Fed. Rep. of Germany ..... 2658119

[51] Int. Cl.[2] ..... B08B 9/00

[52] U.S. Cl. ..... 134/22 R; 134/40; 134/42; 252/170

[58] Field of Search ..... 134/2, 38, 40, 42, 22 R; 252/170; 568/679

[56] References Cited

U.S. PATENT DOCUMENTS

| | | | |
|---|---|---|---|
| 2,610,166 | 9/1952 | Parry | 134/42 |
| 2,907,687 | 2/1958 | Scigliano | 134/38 |
| 3,058,918 | 10/1962 | Gatza | 134/38 |
| 3,485,670 | 12/1969 | Fisher | 134/2 |
| 3,761,429 | 9/1973 | Yamano | 252/170 |

FOREIGN PATENT DOCUMENTS

| | | | |
|---|---|---|---|
| 72964 | 5/1970 | German Democratic Rep. | 134/2 |
| 45-11636 | 4/1970 | Japan . | |
| 47-37694 | 9/1972 | Japan | 134/2 |
| 285887 | of 1929 | United Kingdom | 252/170 |

OTHER PUBLICATIONS

*Glycols*, Union Carbide Chemicals Co., F-4763G, N.Y., pp. 1, 2 and 21.

*Primary Examiner*—Joseph Scovronek
*Assistant Examiner*—Chris Konkol
*Attorney, Agent, or Firm*—Connolly and Hutz

[57] ABSTRACT

For the smooth production of filaments from polyesters it is very important to use accurately cleaned polymers and also accurately cleaned spinnerets. For removing remainders of polyesters from the spinneret a mixture consisting of at least 70 percent by weight of tri-, tetra-, penta- and hexaethyleneglycol and from 2 up to 10 percent by weight mono- and/or diethyleneglycol and up to 20 percent by weight of hepta-, octa- and higher ethyleneglycols has proved to give best results. Zinc acetate may be added for the solving process.

3 Claims, No Drawings

PROCESS FOR CLEANING SPINNERETS

The present invention relates to a process for cleaning spinnerets during the manufacture of polyesters by warming them in a cleaning bath consisting of a polyglycol mixture and catalysts added.

For cleaning the spinnerets used in polyester manufacture from adhering polyester material, there is recommended a series of processes and solvents which have considerable drawbacks:

Cleaning in an alkali metal nitrite bath which requires a temperature of at least 400° C., results rapidly in corrosion so that the life of the expensive nozzle plates is very much reduced.

In the case where hydroxyalkylamines, for example triethanolamine, are employed as cleaning agent, the time required, generally 24 hours, and the compulsory renewal of the total solvent amount after each use make this process complicated and unprofitable.

The use of commercial polyglycols, such as di-, tri- or tetraethyleneglycol with or without addition of catalysts, as is often proposed as solvent for polyester residues, gives good results when large-area apparatus parts, for example ester interchange or condensation vessels, are cleaned. When cleaning spinnerets, however, where the polyester residues must be completely removed from a great number of very narrow and partially even profiled holes, the above solvents have a satisfactory effect only with considerable technological expenditure, for example heating under pressure in an autoclave or the use of ultrasonic apparatus during the cleaning operations. Without these expensive technological means the cleaning effect of the above polyglycols, as well as of the higher polymer homologs, is insufficient.

For example, when spinnerets are cleaned with tri- or tetraethyleneglycol at a temperature of 250° C., the percentage of spinnerets to be aftercleaned ranges from 20 to 30%, and in the case of using a mixture of both glycols, this percentage increases to 50%.

Attempts to obtain an improved cleaning effect or shorter cleaning times by adding catalysts such as they are proposed for example for ester interchange, had no measurable success. At prolonged reaction time, higher polyglycols had no better effect either.

It is therefore the object of the present invention to provide a process which allows cleaning spinnerets efficiently from polymers within short periods, so that they can be reused again for spinning operations.

In accordance with the present invention, there is provided a process using a mixture of polyethyleneglycols consisting of at least 70% by weight, relative to the polyethyleneglycol mixture, of tri-, tetra-, penta-, and hexaethyleneglycol, and of from a minimum 2 to a maximum 10% by weight of mono- and/or diethyleneglycol, and up to 20% by weight of hepta-, octa- and higher ethyleneglycols.

Preferably, zinc acetate is added as catalyst, in an amount of from 0.01 to 0.1, especially of about 0.05% by weight, relative to the polyethyleneglycol mixture.

The process of the invention is surprisingly efficient, which is proved not only by the extraordinarily short times necessary for cleaning the spinnerets soiled by polymer material, but especially by the remarkably small number of cleaned nozzle plates requiring an after-cleaning; that is, 1 to 2 plates per 1000 cleaned ones. An efficiency which can be compared even approximately has not been achieved as yet with the use of any of the cited solvents.

A further advantage of the process of the invention resides in the fact that a cleaning bath may be used up to eight times before it must be freshly prepared. Deteriorations of the cleaning power is safely prevented when ester interchange catalysts, for example zinc acetate or manganese acetate, in an amount of from 0.01 to 0.1% by weight, relative to the polyethyleneglycol mixture, are added before each reuse.

Comparative tests were carried out on on polyethyleneterephthalate chips using polyethyleneglycol mixtures. 500 mg each of polyethyleneterephthalate chips having a relative viscosity of 0.85, measured at 25° C. on an 1% by weight solution of the polymer in phenol/tetrachloroethane in a weight ratio of 3:2, were treated at 250° with 5 g of the polyethyleneglycol or the mixture thereof. The results obtained are listed in the following Table, where T stands for parts by weight, and % for percent by weight.

| Test No. | mono- % di- | tri- tetra- % penta- hexa- ethylene- glycol | hepta- % octa- a. higher | Solving time in min. time using 0.05 wt. % zinc acetate | time without zinc acetate |
|---|---|---|---|---|---|
| acc. to invention | | | | | |
| 1. | 5.0 | 90.0 | 5.0 | 23–25 | 25–40 |
| 2. | 9.5% | 86% | 4.5% | 33–33 | 40–45 |
| Comp. tests 3. | 6.18% | 14.70% | 79.12% | 60–70 | 60–70 |
| 4. | 2.60% | 51.5% | 45.90% | 50–50 | 95–95 |
| 5. | 1.40% | 32.25% | 66.35% | 75–75 | 95–95 |
| 6. | 2.50% | 45.00% | 52.50% | 85–90 | 100–105 |
| 7. | 1.25% | 22.50% | 76.25% | 110–120 | 140–160 |
| 8. | 6% | 3% | 91% | 115–140 | — |
| 9. | 0.2% | 13.0% | 86.8% | 145–160 | — |
| 10. | 0% | 0% | 100% | stopped after 3 hrs. | |

These results prove that the cleaning times when using the polyethyleneglycol composition of the invention are considerably shorter than those attained with the use of all other comparative solvents. Addition of lower or higher polyalkylene glycols increased the cleaning times. As already mentioned, the use of tetraethyleneglycol resulted in a considerably higher number of nozzles to be after-cleaned than that of the process of the invention.

EXAMPLE 11

By means of a suitable handling device, 80–120 of the nozzle plates to be cleaned were introduced into a polyethyleneglycol bath having the following composition:

| | % by weight |
|---|---|
| mono-ethyeneglycol | 1 |
| di- | 4 |
| tri- | 20 |
| tetra- | 30 |
| penta- | 25 |
| hexa- | 15 |
| hepta- | 4 |
| octa- | 1, |

contents: 50 kg of polyglycol containing 25 g of zinc acetate. The bath was heated to 250° C. After 4 hours, the nozzle plates were removed from the cleaning bath and rinsed for 15 minutes in water having a temperature of 90° C., and subsequently rinsed once in cold water. The nozzle plates were introduced in still wet state for 10 minutes into a bath of 10 % sodium hydroxide solution having a temperature of 90° C., where they were subjected to an ultrasonic treatment. Subsequently, they were rinsed twice for 10 minutes in water having a temperature of 40°, and finally dried by blowing under pressure. The spinneret plates were then completely free from polyester residues.

After addition of 25 g of zinc acetate.$2H_2O$, the polyglycol bath was ready for further cleaning operations; it had to be freshly prepared after a eight time reuse at the earliest. Only 1 to 2 per 1000 spinneret plates so cleaned required after-cleaning.

What is claimed is:

1. Process for the cleaning of spinnerets during the manufacture of polyesters by warming them in a cleaning bath of a polyglycol mixture, which comprises using a mixture of polyethylene glycols consisting of at least 70% by weight, relative to the polyethylene glycol mixture, of polyethylene-glycols of the group consisting of tri-, tetra-, penta- and, hexaethylene glycol and of from a minimum of 2 to a maximum of 10% by weight of one or more polyethylene glycols of the group consisting of mono- and diethylene glycol, and up to 20% by weight of polyethylene glycols of the group consisting of hepta-, octa- and higher ethylene glycols.

2. The process as claimed in claim 1, which comprises adding as catalyst to the polyethylene glycol mixture from 0.01 to 0.1% by weight of zinc acetate. 2 $H_2O$, relative to the polyethylene glycol mixture.

3. The process as claimed in claim 2, wherein the amount of said catalyst is 0.05%.

* * * * *